US008465090B1

(12) United States Patent
O'Connor

(10) Patent No.: US 8,465,090 B1
(45) Date of Patent: Jun. 18, 2013

(54) CHAIR FOR USE DURING WADE FISHING

(76) Inventor: Joel Brandon O'Connor, Franklinton, LA (US)

( * ) Notice: Subject to any disclaimer, the term of this patent is extended or adjusted under 35 U.S.C. 154(b) by 207 days.

(21) Appl. No.: 13/134,316

(22) Filed: Jun. 6, 2011

(51) Int. Cl.
*A47C 4/28* (2006.01)
*A47C 7/62* (2006.01)
*A47C 7/66* (2006.01)
*A47C 1/14* (2006.01)

(52) U.S. Cl.
USPC ..... 297/45; 297/184.16; 297/188.01; 297/188.14; 297/188.18; 297/188.19; 297/188.2; 297/344.18

(58) Field of Classification Search
USPC ..... 297/4, 45, 184.16, 188.01, 188.14, 297/188.18, 188.19, 188.2, 344.18
See application file for complete search history.

(56) References Cited

U.S. PATENT DOCUMENTS 401,302 A 4/1889 Purdy
444,621 A * 1/1891 Schneider ..... 248/155.1
595,450 A 12/1897 Archer
930,607 A * 8/1909 Morrill ..... 52/165
2,905,513 A * 9/1959 Kane ..... 108/128
2,978,012 A * 4/1961 Norseen ..... 108/116
3,817,483 A * 6/1974 Garvey ..... 248/155
4,098,478 A * 7/1978 Spitzke ..... 248/156
4,407,505 A * 10/1983 Kendziorski ..... 473/173
4,848,712 A * 7/1989 Russell ..... 248/155.2
D309,989 S * 8/1990 Gotts ..... D6/364
5,060,896 A * 10/1991 Hobbins ..... 297/344.18 X
5,247,900 A * 9/1993 Sobczak ..... 116/209
5,364,163 A * 11/1994 Hardison ..... 297/4 X
5,409,291 A 4/1995 Lamb et al.
5,536,068 A 7/1996 Valentor et al.
5,673,966 A * 10/1997 Morton, Jr. ..... 297/4
5,954,248 A * 9/1999 Jasper ..... 297/344.18 X
6,033,016 A * 3/2000 Haywood ..... 297/195.11
6,036,148 A * 3/2000 Shank ..... 297/344.18 X
6,056,353 A * 5/2000 Meara ..... 297/344.18 X
6,176,545 B1 * 1/2001 Hambleton ..... 297/4
6,308,468 B1 * 10/2001 Caruso ..... 52/165
6,354,231 B1 3/2002 Morris
6,439,659 B1 8/2002 Neubauer, Jr.
6,893,097 B1 * 5/2005 Ebensperger et al. ... 297/344.18 X
6,953,180 B1 * 10/2005 Ruvalcaba et al. ..... 248/530
D512,576 S 12/2005 Szyperski et al.
6,997,511 B2 * 2/2006 Marchand et al. ... 297/344.19 X
7,226,126 B1 * 6/2007 Spanovich ..... 297/184.16
7,562,930 B1 * 7/2009 Rondeau ..... 297/184.16
7,594,696 B2 * 9/2009 Girard ..... 297/344.18 X
7,631,447 B2 * 12/2009 Morton et al. ..... 40/607.05
8,091,962 B2 * 1/2012 Quinn ..... 297/184.16
8,231,172 B2 * 7/2012 Quinn ..... 297/184.16
8,303,032 B1 * 11/2012 Platta ..... 297/4

* cited by examiner

*Primary Examiner* — Rodney B White
(74) *Attorney, Agent, or Firm* — Peter Loffler

(57) ABSTRACT

A chair for use during wade fishing in order to allow the user to sit above the water line has a director's chair with four feet, two forwardly located and two rearwardly located. Extensions are threadably removed within receivers attached to each foot, the extensions having pointed ends that are received within the sandy bottom below the water line. Steps are located just below the feet to help a user get into the chair. Weight distribution disks are frictionally held on the extensions to prevent undue sinking of the chair. Pouches, both mesh and waterproof, are attached to the arm rests and the seat of the chair. A rod holder is receivable within an opening on the arm rest. A receiver is attached to the frame of an upper portion of the chair to hold an umbrella.

16 Claims, 3 Drawing Sheets

CHAIR FOR USE DURING WADE FISHING

BACKGROUND OF THE INVENTION

1. Field of the Invention

The present invention relates to a chair that is used during wade fishing such that the chair allows a person to be able to sit offshore and to holds various fishing paraphernalia.

2. Background of the Prior Art

Wade fishing involves standing offshore in approximately waist deep water and fishing for various type of fish including bass and mullet, among others. As many people engage in wade fishing for hours at a time, sometimes although not always, the fishing person wears some form of water impervious outerwear so as not to be soaked to the bone during the fishing day. While extremely fun, the process can be tiring. As the person stands in the waist deep water, sitting down in a regular chair is not an option so that standing is the norm of the day and the person engaged in fishing can become quite tired. Additionally, as the person is offshore, the retrieval of any supplies, such as lures, bait, lunch, etc., usually requires the person to wade back to shore, retrieve the necessary supplies, and wade back to the fishing spot. Some holders have been devised that float and hold the supplies high and dry. However, such devices need to be tied to the person or otherwise anchored and tend to get in the way of the user.

Accordingly, there exists a need in the art for a device that is used during wade fishing that addresses the above stated shortcomings associated with the sport. Specifically such a device must allow the fisherman to be able to sit without the need to temporarily discontinue fishing. Additionally, such a device must be able to hold various accessories for use by the fisherman so that he or she does not have to wade back to shore whenever such accessories are needed. Ideally, such a device will be of relatively simple design and construction so that it is relatively inexpensive to manufacture so as to be affordable to a large segment of the wade fishing population. The device should be easy to use and maintain.

SUMMARY OF THE INVENTION

The chair for use during wade fishing of the present invention addresses the aforementioned needs in the art by providing a chair that allows the fisherman to be able to sit down while fishing offshore without the need to temporarily discontinue fishing. The chair for use during wade fishing is able to hold various accessories for use by the fisherman thereby negating the need to wade back to shore whenever such accessories are needed. The chair for use during wade fishing is of relatively simple design and construction so that it is relatively inexpensive to manufacture making the device affordable to a large segment of the wade fishing population. The present invention is easy to use and maintain.

The chair for use during wade fishing of the present invention is comprised of a folding director's chair that has a frame structure with four feet with two of the feet being located forwardly of the chair and two of the feet being located rearwardly of the chair. A seat and a seat back are attached to the frame structure as is one or more arm rests each with an opening. Four receivers are provided and each receiver is attached to a respective one of the four feet of the director's chair. Four extensions are provided and each has a first end that is threadably received within a respective one of the four receivers and a second pointed end. Two steps are provided such that each step is attached to a respective one of the receivers that is attached to one of the forwardly located feet. Four distribution disks are provided, each having an opening through which a second end of one of the extensions passes so as to allow each disk to be being slidably and removably attached to a respective one of the four extensions. A cylindrical receiver is attached to the frame structure proximate an upper portion of the seat back. A first pouch is attached to one of the arm rests while a second pouch is attached to the other of the arm rests. The first pouch is made from a mesh material while the second pouch is made from a water impervious material. A third pouch is attached to the seat. A rod holder is provided that has an upper hollow cylindrical section and a lower hollow cylindrical section with a closed bottom such that the upper section has a greater diameter than the diameter of the lower section. The holder is removably receivable within the opening of the arm rest. A carrying strap attached to the director's chair.

BRIEF DESCRIPTION OF THE DRAWINGS

Similar reference numerals refer to similar parts throughout the several views of the drawings.

DESCRIPTION OF THE PREFERRED EMBODIMENT

Figure 1:
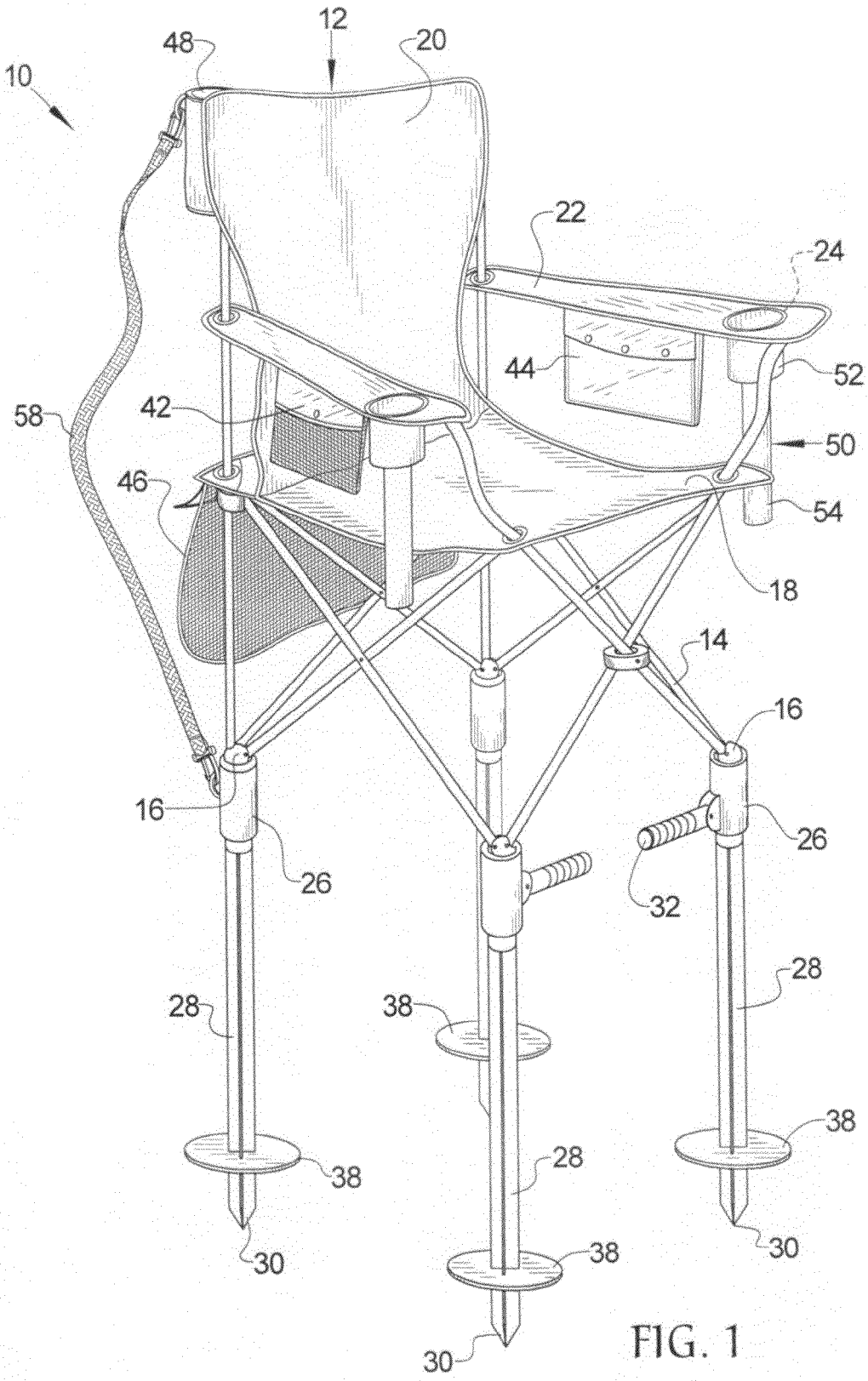
FIG. 1 is a perspective view of the chair for use during wade fishing of the present invention.
Figure 2:
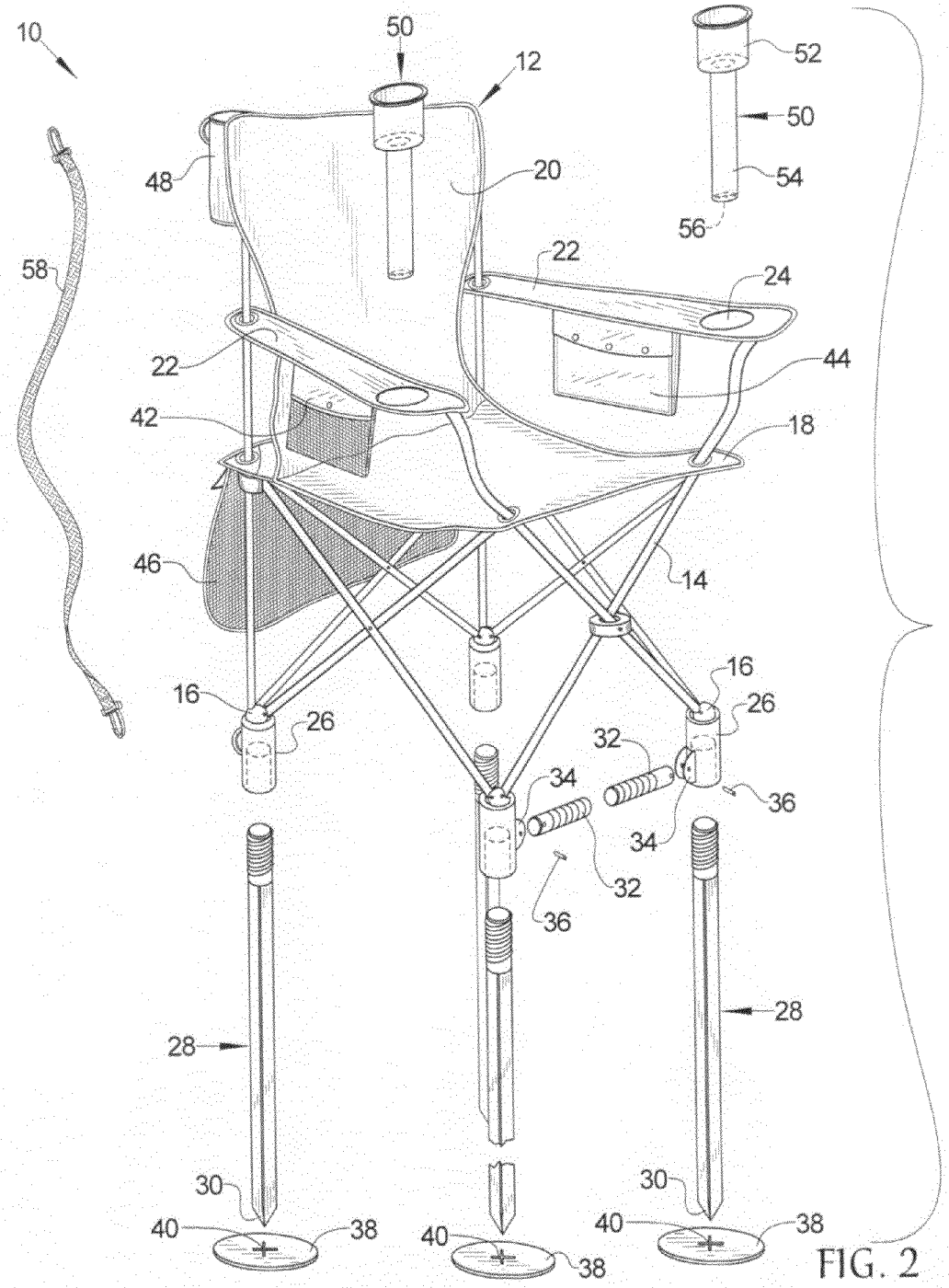
FIG. 2 is an exploded view of the chair for use during wade fishing.
Figure 3:
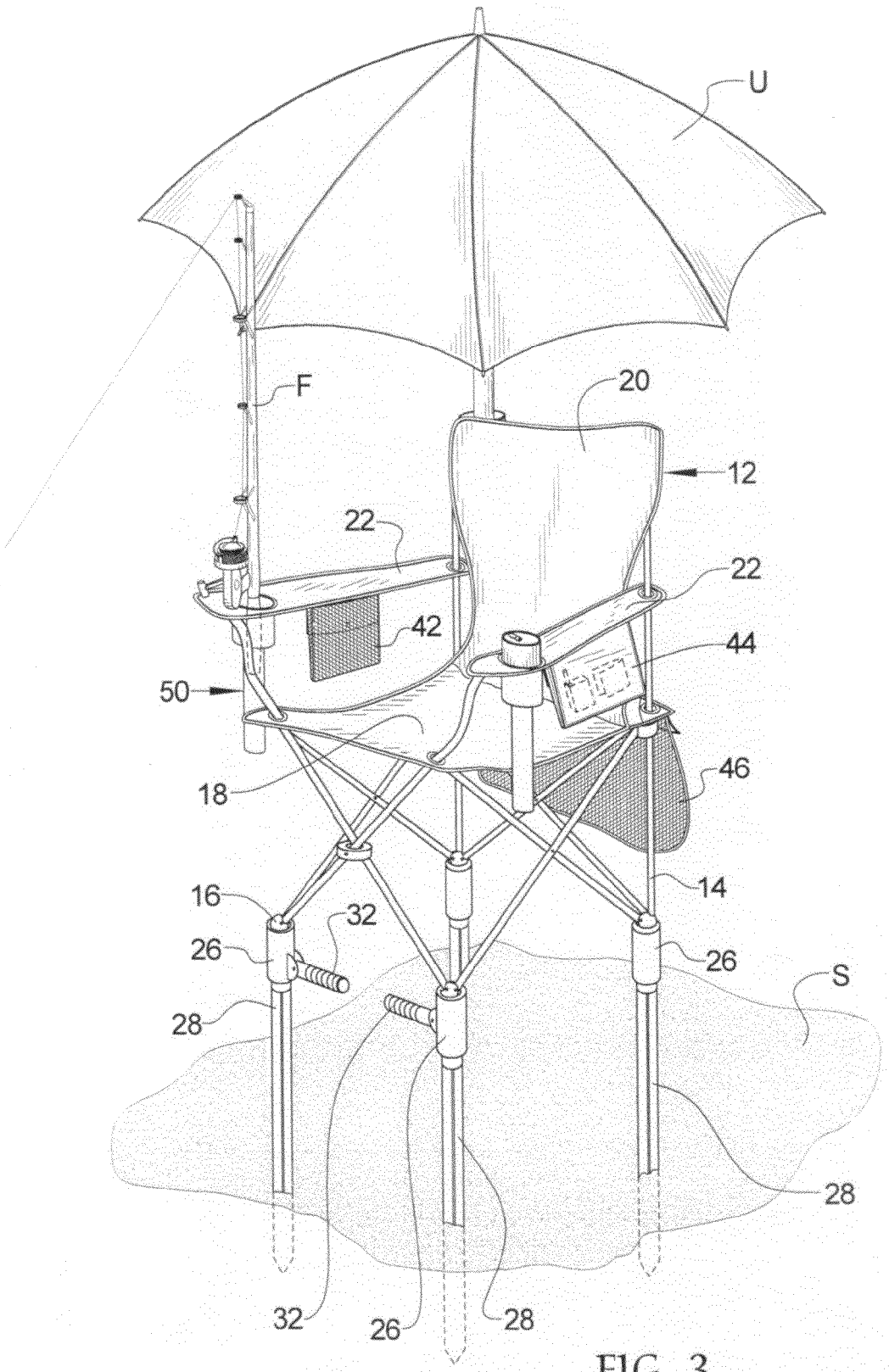
FIG. 3 is a perspective view of the chair for use during wade fishing in use.

Referring now to the drawings, it is seen that of the chair for use during wade fishing of the present invention, generally denoted by reference numeral 10, is comprised of an upper chair 12. As seen, the upper chair 12 is a typical folding director's chair that has a folding frame structure 14 which terminates at four feet 16 at its lower limits. A seat 18 and a seat back 20, typically made of Nylon, canvas, etc., are attached to the frame structure 14 for holding an occupant. The seat 18 and the seat back 20 may but need not be an integral unit A pair of arm rests 22 are also attached to the frame structure 14 and each has an opening 24 thereon for holding drink receptacles, etc., therein. The upper chair 12 is capable of articulating between a folded position (not illustrated) for compact storage and transport, and an unfolded position such that the upper chair 12 rests on a surface on its four feet 16 and the user sits in the seat 18 and rests on the seat back 20.

The upper chair 12 is modified by providing four receivers 26 and attaching each receiver 26 to a foot 16 of the upper chair 12, one receiver 26 per foot 16. Attachment of the receiver 26 to its respective foot 16 is by any manner known in the art including screwing, ultrasonic welding, adhesion, etc. Four extensions 28 are provided and each one is threadably received within a receiver 26, one extension 28 per receiver 26. As seen, each extension 28 is an elongate member that has a pointed lower end 30. The four extensions 28 are of equal length and may be telescoping (not illustrated) for added length of the extensions 28. Alternately, additional extensions (not illustrated) can be provided that are removably attachable to the illustrated extensions 28 to increase the overall length of each extension 28. A step 32 protrudes outwardly from at least two of the receivers 26, the step 32 being oriented generally normal to the longitudinal axis of the extension 28 when properly attached. As seen, each step 32 is removably attachable between a pair of flanges 34 located on the receiver 26 with a screw 36 passing through the flanges 34 and the step 32.

A distribution cap 38 has an opening 40 and is positioned such that the lower end 30 of the extension 28 protrudes through the opening 40 of the distribution cap 38 and the distribution cap 38 slides up the extension 28 until the distribution cap 38 is frictionally held in place about the extension 28, the extension 28 being tapered to allow the friction hold of the distribution cap 38 in this position. As seen the distribution cap 38 is a relatively flat disk member that distributes the weight of the device 10 whenever the device 10 is positioned in relatively soft sand S in order to prevent the device 10 from sinking too low into the sand S (working in similar manner to a snow shoe). The slidable positioning of the distribution caps 38 with respect to their respective extensions 28 allows for some vertical movement as well as tilting of the distribution caps 38 to accommodate uneven terrain S encountered by a chair 10.

A first pouch 42 is attached to one of the arm rests 22 of the upper chair 12, the first pouch 42 being made of a mesh material and capable of holding items that can get wet. A second pouch 44 is attached to the other arm rest 22 of the upper chair 12, this second pouch 44 being made from a water impervious material and is capable of holding items that must stay dry. A third pouch 46 is attached to the seat 18 of the upper chair 12, this third pouch 46 being made of mesh material and is substantially larger than the other two pouches 42 and 44 and is designed to hold relatively larger items. A cylindrical receiver 48 is attached to the frame structure 14 proximate the upper portion of the seat back 20 and is designed to hold an umbrella U. One or more fishing pole holders 50 are provided, each having an upper hollow cylindrical section 52 and a lower hollow cylindrical section 54 with a closed bottom 56, the lower section 54 having a smaller diameter than the upper section 52. Each fishing pole holder 50 is removably receivable within the opening 24 of the arm rest 22 and each removably receives a fishing pole F therein, the upper section 52 also capable of holding a drink receptacle. A strap 58 his removably attachable to the cylindrical receiver 48 and to the receiver 26 of one of the rearwardly placed extensions 28 and allows the chair 10 to be easily carried.

In order to use the chair used during wade fishing 10 of the present invention, the various pouches 42, 44, and 46, are populated as desired. The steps 32 are attached to the flanges 34 on the forward two receivers 26. The forward two extensions 28 are threadably attached to the forward two receivers 26 attached to the upper chair 12. The rearward two extensions 28 are attached in similar fashion to their respective receivers 26. The distribution caps 38, if used, are positioned on each extension 28 and frictionally held in place. The device 10 is positioned within the sand S offshore by pressing the extensions 28, lower end 30 first, into the sand S and allowing the extensions 28 to partially sink into the sand S, up to the level of the distribution disk 38, if used. Ideally, the seat 18 is located above the water line when the chair 10 is properly sunk within the sand S. If desired, an umbrella U is placed into the cylindrical receiver 48. If desired, the fishing pole holders 50 are positioned into the openings 24 of the arm rests 22. The chair 10 is now ready for use. The user climbs into the upper chair 12 with the assistance of the steps 32 located on the forward two receivers 26 and sits in the upper chair 12. As the seat 18 and the seat back 20 are above the waterline, the majority of the user's body is above the water line and dry. The umbrella U helps keep the user cool and somewhat out of the sun. The various pouches 42, 44, and 46, allow the user to have various accessories on hand without the need to return to shore to retrieve such accessories. The fishing pole holders 50 allow the user to fish hands free.

When the fishing day is over, the umbrella U is removed from the cylindrical receiver 48 and folded as appropriate. Accessories are return to their respective pouches 42, 44, and 46 as desired. The fishing pole holders 50 are removed from the openings 24 of the arm rests 22 and stowed. The device 10 is removed from the sand S and the extensions 28 are detached from their respective receivers 26. If desired, the steps 32 are either removed or pivoted out of the way. The upper chair 12 is folded in appropriate fashion and transported and stowed.

While the invention has been particularly shown and described with reference to an embodiment thereof, it will be appreciated by those skilled in the art that various changes in form and detail may be made without departing from the spirit and scope of the invention.

I claim:

1. A seating device comprising:

a folding director's chair having a frame structure with four feet, two of the feet located forwardly and two of the feet located rearwardly, a seat, a seat back, and an arm rest with an opening;

four receivers, each receiver attached to a respective one of the four feet of the director's chair;

four extensions each having a first end threadably received within a respective one of the four receivers and a second pointed end such that each extension is tapered outwardly in proceeding from the second end toward the first end; and four distribution disks, each having an opening through which the second end of a respective one of the extensions passes so as to allow each distribution disk to be slidably and removably attached to the respective one of the four extensions.

2. The seating device as in claim 1 further comprising two steps, each step attached to a respective one of the receivers that is attached to one of the feet located forwardly.

3. The seating device as in claim 1 further comprising a cylindrical receiver attached to the frame structure proximate an upper portion of the seat back.

4. The seating device as in claim 1 comprising a first pouch attached to the arm rest.

5. The seating device as in claim 4 wherein the first pouch is made from a mesh material.

6. The seating device as in claim 4 wherein the first pouch is made from a water impervious material.

7. The seating device as in claim 4 comprising a second pouch attached to the seat.

8. The seating device as in claim 1 further comprising a holder having an upper hollow cylindrical section and a lower hollow cylindrical section with a closed bottom, the upper section having a greater diameter than the diameter of the lower section, the holder removably receivable within the opening of the arm rest.

9. The seating device as in claim 1 further comprising a carrying strap attached to the director's chair.

10. A seating device comprising:

a folding director's chair having a frame structure with four feet, two of the feet located forwardly and two of the feet located rearwardly, a seat, a seat back, and an arm rest with an opening;

four receivers, each receiver attached to a respective one of the four feet of the director's chair;

four extensions each having a first end threadably received within a respective one of the four receivers and a second pointed end such that each extension is tapered outwardly in proceeding from the second end toward the first end;

a pair of two steps, each step attached to a respective one of the receivers that is attached to one of the feet located forwardly;

a cylindrical receiver attached to the frame structure proximate an upper portion of the seat back; and four distribution disks, each having an opening through which the second end of a respective one of the extensions passes so as to allow each distribution disk to be slidably and removably attached to the respective one of the four extensions.

11. The seating device as in claim 10 comprising a first pouch attached to the arm rest.

12. The seating device as in claim 11 wherein the first pouch is made from a mesh material.

13. The seating device as in claim 11 wherein the first pouch is made from a water impervious material.

14. The seating device as in claim 11 comprising a second pouch attached to the seal.

15. The seating device as in claim 11 further comprising a holder having an upper hollow cylindrical section and a lower hollow cylindrical section with a closed bottom, the upper section having a greater diameter than the diameter of the lower section, the holder removably receivable within the opening of the arm rest.

16. The seating device as in claim 15 further comprising a carrying strap attached to the director's chair.

* * * * *